US005222619A

United States Patent [19]

Gregory

[11] Patent Number: 5,222,619

[45] Date of Patent: Jun. 29, 1993

[54] ENCLOSURE WITH WEDGE LOCKING DEVICE

[75] Inventor: Donald W. Gregory, Carlsbad, N. Mex.

[73] Assignee: Gregory Environmental Systems, L.P., Carlsbad, N. Mex.

[21] Appl. No.: 843,881

[22] Filed: Feb. 27, 1992

[51] Int. Cl.[5] ..... B65D 45/16

[52] U.S. Cl. ..... 220/324; 220/908; 292/343; 292/302; 292/292

[58] Field of Search ..... 220/324, 908; 292/343, 292/302, 292

[56] References Cited

U.S. PATENT DOCUMENTS

| | | | |
|---|---|---|---|
| 1,142,231 | 6/1915 | Brelle, Sr. | 220/324 X |
| 1,583,433 | 5/1926 | Witt | 220/324 |
| 2,665,822 | 1/1954 | Crawford | 220/324 |
| 2,805,788 | 9/1957 | Allbright et al. | 220/324 |
| 4,072,333 | 2/1978 | Hutter, III | 292/292 |
| 4,155,578 | 5/1979 | Rolland | 292/292 |
| 4,371,092 | 2/1983 | Teague | 220/324 |
| 4,609,125 | 9/1986 | Willingham | 220/324 |
| 5,102,001 | 4/1992 | Teague et al. | 220/324 |

*Primary Examiner*—Allan N. Shoap
*Assistant Examiner*—Paul A. Schwarz
*Attorney, Agent, or Firm*—Marcus L. Bates

[57] ABSTRACT

An enclosure comprising a container having a bottom, a sidewall attached to the bottom and terminating in an open end. The sidewall has an inner wall surface opposed to an outer wall surface. A closure member made complementary to the open end can be removably affixed thereto. The closure member provides a downwardly extending lip having an inner wall surface opposed to an outer wall surface, one of which slidably adjoins one of said inner and outer wall surfaces of the container wall when the closure member is mated respective to the container. A fixed locking member having an inclined rail thereon is attached to the outer wall surface. Also provided is a sliding locking member having an upper flange that bears against the top of the closure member and a lower rail engaging member of a size to receive the rail therewithin to thereby force the closure member toward the container bottom when the sliding locking member simultaneously engages the closure member and the fixed locking member.

11 Claims, 2 Drawing Sheets

ENCLOSURE WITH WEDGE LOCKING DEVICE

BACKGROUND OF THE INVENTION

Many leak proof, hermetically sealable containers can be found in the prior art. Some of these containers have a long life expectancy, can be locked, and can safely store various material therewithin. However many of these prior art containers can either too complex and therefore too expensive, or else too fragile for the storage of radio active and other dangerous toxic substances.

Therefore, there is a need for a rugged, inexpensive, leak proof, hermetically sealable container that has a long useful life, that can be locked, and within which various material, including smaller containers of radio active and other dangerous toxic substances can be stored safely. The containers should be easily sealed to render them tamper proof, and preferably are constructed so that they can be safely stacked to conserve space. The containers and closure members should require very little labor to manually assemble, and they should be re-sealable to enable reuse thereof. It also would be desirable that such a container be made of metal, including stainless steel, as well as plastic or fiberglass in order to reduce corrosion thereof. The container should be available in various sizes and geometrical configurations. Apparatus meeting these and other criteria is the subject of the present invention.

SUMMARY OF THE INVENTION

The present invention relates to sealable storage containers and closure members, and specifically to an improved locking device for mating a closure member to a container. The container terminates in an open end, and has a closure member removably affixed to and conforming to the configuration of the open end. A downwardly extending lip on the closure member telescopingly receives the open end of the container.

The improved locking device is used in combination with a container and a closure member, and provides an improved storage facility. The locking device includes a fixed locking member that is attached to the container outer wall surface and which has an inclined rail formed thereon. A sliding locking member cooperates with the fixed locking member and has an upper flange that abuts the top surface of the closure member, and an inclined lower rail engaging member of a size to receive the rail therewithin. The sliding locking member forces the closure member toward the bottom of the container when the sliding locking member simultaneously engages the closure member upper surface and the rail of the fixed locking member.

A plurality of fixed and sliding locking members are positioned in spaced relationship about the exterior of the container and closure member. The container and closure member may be of any desired configuration, but preferably is square, circular or polygonic. The closure member is provided with a lip for telescopingly receiving the open end of the container therein, thereby facilitating assembly of the closure member to the container opening.

In the preferred embodiment of the invention, there is a fixed locking member on each side of the polygon, and seal means between the open end and the closure member. The fixed locking member is in the form of a bent plate member having an upper part attached to the outer surface of the sidewall of the container, and a lower part that is displaced from the container and terminates in a rail at the lower end thereof. The rail downwardly slopes respective to the open end to provide a wedge-like action when engaged by a sliding locking member.

The sliding locking member is also in the form of a bent plate member having a flange at the upper end thereof, with the lower marginal end thereof being bent in a reverse direction to provide a track receiving cavity which downwardly slopes complementary respective to the slope of the rail and thereby receives the rail in captured relationship therewithin.

The sliding locking member is forced into position with hammer blows to tighten the closure member against the open end of the container, with the resultant force depending on the angle of the rail and cavity as well as the magnitude of the force of the hammer blows. A suitable gasget can be interposed between the container and the closure member, so that the sliding locking member simultaneously tightens the closure member against the open end of the container as the gasget is compressed.

Therefore a primary object of the present invention is the provision of an efficient locking device that tightens a closure member onto a container with a wedge-like action.

Another object of this invention is the provision of a cam type locking device by which a closure member is tightened onto a container with a wedge-like action.

A further object of this invention is to disclose and provide a wedge-like locking device comprising a fixed and a slidable locking member that cooperate together and wedgedly forces a closure member and a container toward one another with great force.

A still further object of this invention is to provide improvements in closure members for containers by the employment of a wedge-type locking device for moving the closure member and container together with great force provided by the locking device.

Another and still further object of this invention is the provision of a new combination of a locking device, container, and closure member that is wedgedly forced together in a removable and reusable manner.

An additional object of the present invention is the provision of an improved enclosure having a locking device that seals a closure member to a container opening with a wedge-like action.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
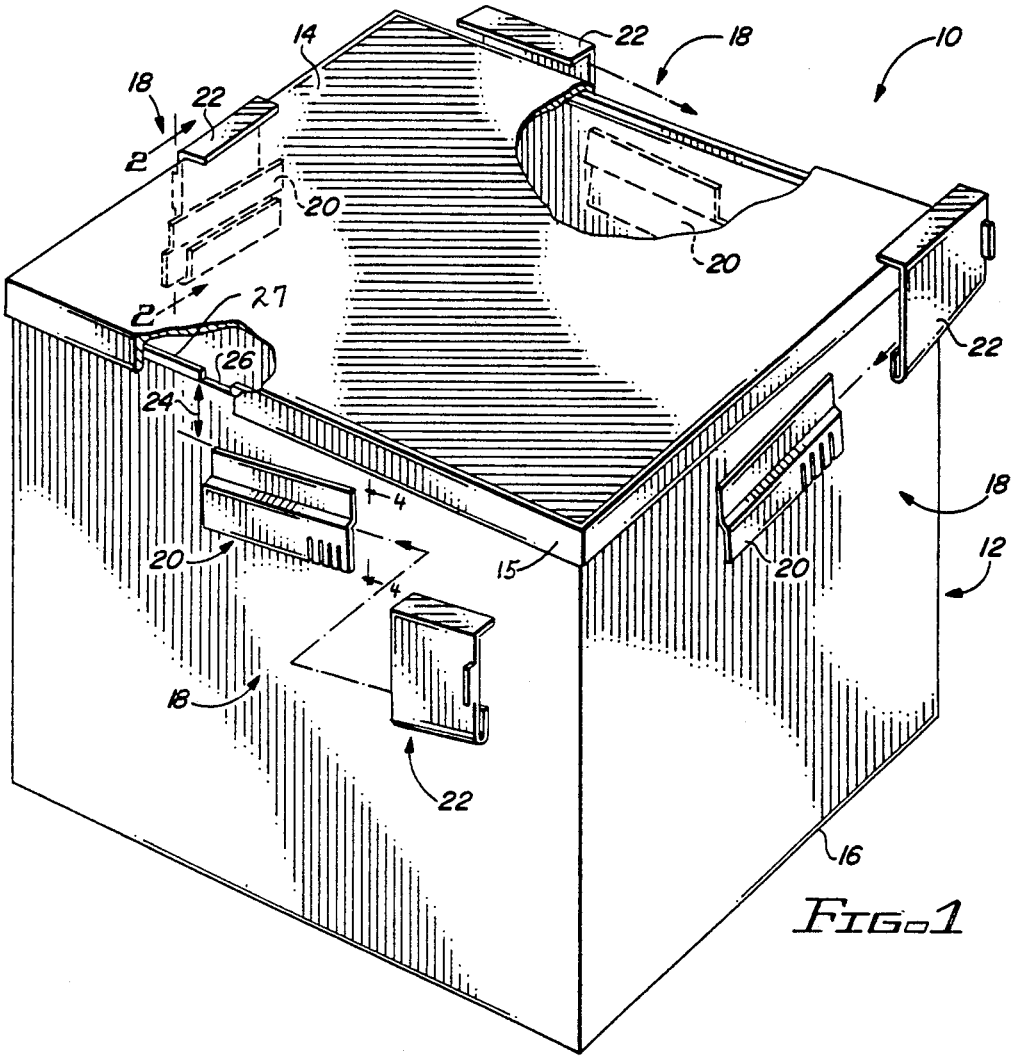
FIG. 1 is a perspective, three-quarter, front view of an enclosure made in accordance with the present invention, with some parts thereof being broken away therefrom, and some of the remaining parts being shown in cross-section.

FIG. 1 illustrates an enclosure 10 made in accordance with the present invention. The enclosure 10 comprises a container 12 and a closure member 14. The closure member 14 has a lip 15. The lip 15 has opposed sidewalls, one of which is seen at 13. The container 12 has a bottom 16 to which there is connected a sidewall 18 that upwardly extends from the bottom 16 and terminates in an open end. The closure member 14 conforms to the configuration of the open end. A fixed locking member 20, made in accordance with this invention, is attached to the outer wall surface of the sidewall 18 and cooperates with a sliding lock member 22, made in accordance with this invention. The sliding locking member 22 engages the fixed locking member 20 with a wedge-like action to hold the closure member 14 against the open end of the container.

Figure 3:
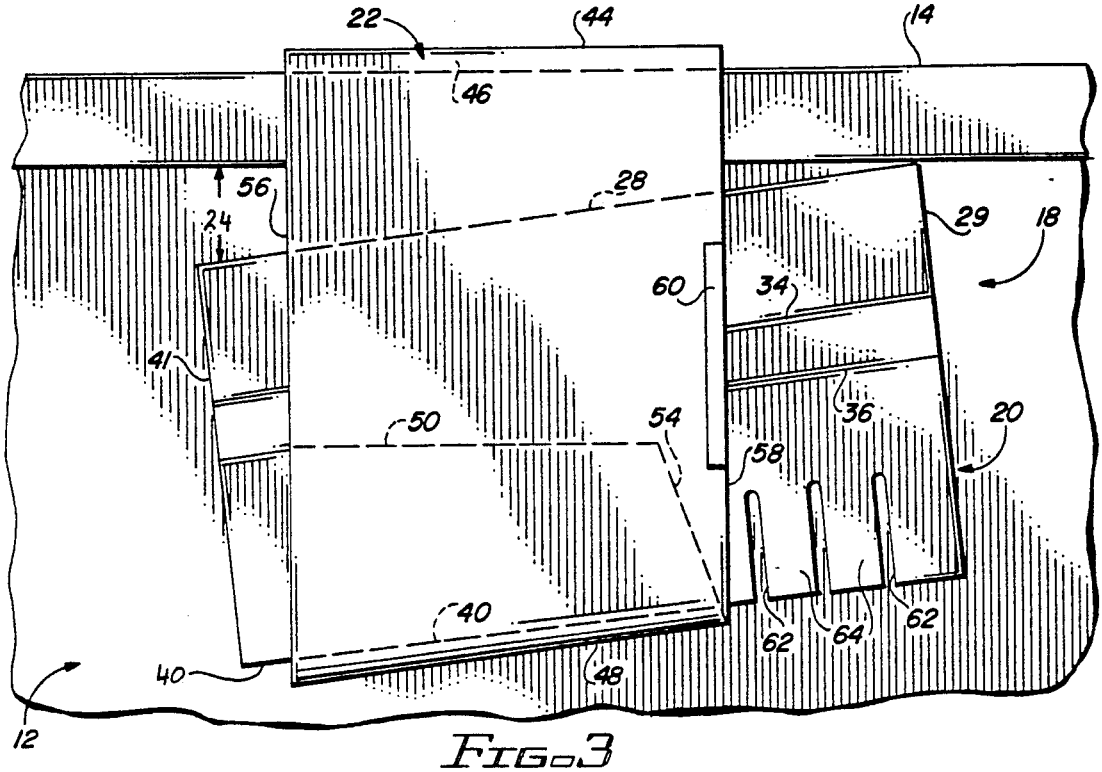
FIG. 3 is an enlarged, fragmentary, detailed front view of the invention.

In FIGS. 1 and 3, it will be noted that the fixed locking member 20 is inclined an amount as indicated at 24 respective to upper edge 26 that defines the container opening. The degree of inclination determines the mechanical advantage effected by forced movement of the sliding locking member 22 as it makes engagement with the fixed locking member 20. A suitable gasket or seal 27 is interposed between upper edge 26 and the inner wall of the closure member.

Figure 4:
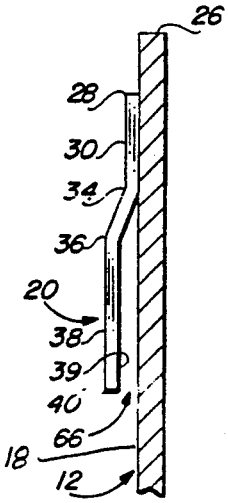
FIG. 4 is an enlarged, cross-sectional detail taken along lines 4—4 of FIG. 1, and showing parts of the foregoing figures.

As best seen in FIGS. 1–4, the fixed locking member 20 is a deformed plate member that is bent into the configuration illustrated in FIG. 4. The bent plate member that forms the fixed locking member has an upper end 28, and an upper marginal end 30 has a rear face 32 that bears against and is attached to the outer surface of the sidewall 18 of container 12. The plate member that forms the fixed locking member 20 receives a band along the illustrated bend lines at 34 and 36 to dispose the lower marginal end 38 in spaced relationship respective to the surfaces of the sidewall 18. The inner face 39 is spaced from the surface of sidewall 18. Lower terminal end 40 provides an inclined rail member. Numerals 41 and 29 indicate the opposed ends of fixed locking member 20.

Figure 6:
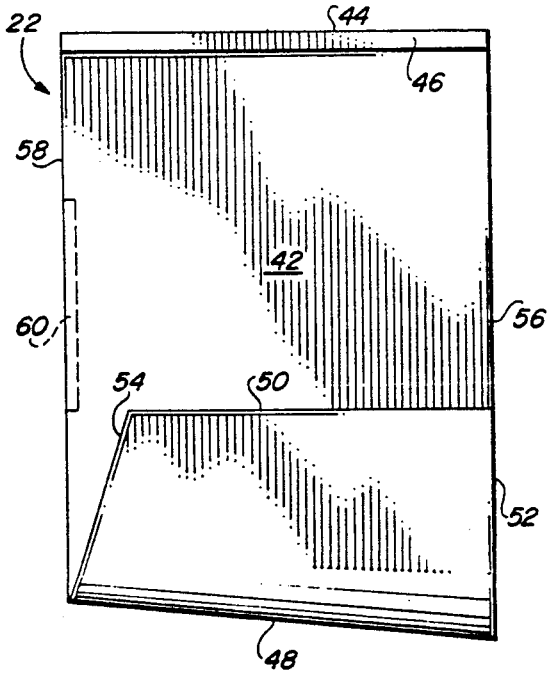
Figure 5:
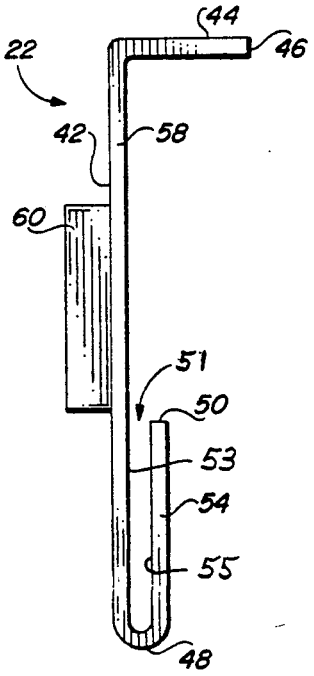
FIG. 5 is an end view showing part of the apparatus disclosed in some of the foregoing figures; and, FIG. 6 is an elevational view of part of the apparatus disclosed in FIGS. 1, 2, 3 and 5.

In best seen in FIGS. 5 and 6, numeral 42 indicates the back side of the sliding locking member 22 which receives a bend at the upper marginal end thereof to form flange 44 that is perpendicularly arranged respective to surface 42 thereof and which terminates at upper terminal end 46. The lower marginal end of sliding locking member 22 receives a reverse bend at 48 and terminates at terminal end 50 to provide a rail receiving cavity 51 located within the lower end thereof.

As best seen in FIGS. 5 and 6, the folded member of the sliding locking member 22 has opposed edges 52 and 54, with edge 52 being a continuation of leading edge 56, while edge 54 is a continuation of trailing edge 58. The edge 54 preferably is inclined at the illustrated angle respective to edge 52 and 58. Lug 60 can be eliminated where space is at a premium. Lug 60 extends at a right angle respective to the back side 42.

Cutouts 62 provide tabs 64 on the fixed locking member 20. The tabs 64 may be bent either inwardly or outwardly from the container to lock the sliding locking member 22 into locked position.

Figure 2:
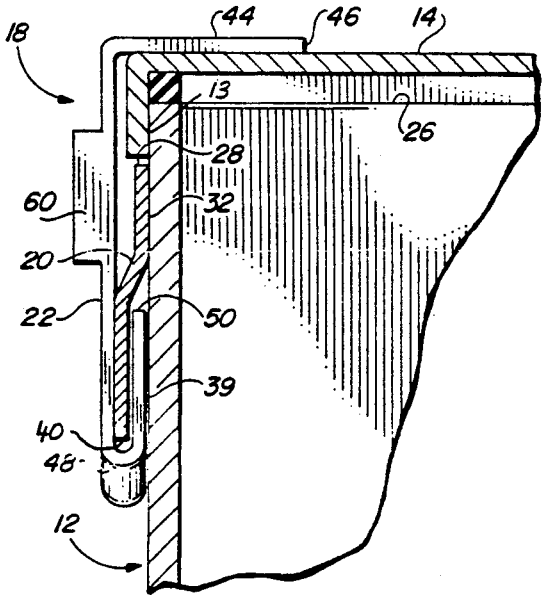
FIG. 2 is an enlarged, fragmentary, detailed, cross-sectional view taken along line 2—2 of FIG. 1.

In FIG. 2 it will be noted that the lower terminal end 40 of fixed locking member 20 tightly engages the lower end of the folded member 48, while terminal end 50 of the sliding locking member 22 is spaced from the inclined medial part of the fixed locking member 20.

The lower terminal end of fixed locking member 20 is inclined respective to the upper face of closure member 14, which is also defined by the peripheral edge that forms the opening at upper edge 26 of the container. The lower reverse bend 48 of the sliding locking member 22 is likewise inclined and preferably is parallel to the terminal end 40 which forms an inclined rail on the fixed locking member. The inclined rail cooperates with the lower marginal end of the sliding lock member with a wedge-like action. The opposed surfaces 38 and 39 of the fixed locking member that define the inclined rail are slidably received against the confronting surfaces 53 and 55 of the rail receiving cavity 51 presented by the reverse bend at 48 of the sliding locking member 22. The surfaces 38, 39, 53, 55 and 18 may be positioned to slidably abut one another as best seen illustrated in FIG. 2.

A plurality of co-acting fixed and sliding locking members 20 and 22 are spaced apart from one another and used on a variety of configurations of enclosures, including round, oblated, square, and other polygonic shaped enclosures. The square enclosure illustrated herein is the preferred embodiment. The preferred embodiment of the enclosure is fabricated from metal, plastic, fiberglass, and any other suitable material.

In carrying out the invention, the material of construction is selected as well as the configuration of the enclosure. The fixed locking member 20 is attached at an appropriate angle and properly spaced below edge 26 of the container, in the illustrated manner of FIG. 1, whereby flange 44 and the reverse bend at 48, respectively, of the sliding locking member, concurrently engage the upper surface of closure member 14 and the rail formed at the lower end 40 of fixed locking member, respectively, so that the sliding locking member can be hammered into the position of FIG. 3 as the closure member is wedgedly forced against gasket or seal 27.

After the sliding locking member 22 has engaged the fixed locking member 20, it is impacted with a hammer by striking edge 58 or lug 60 until the closure member is wedged as tight against gasket 27 as is deemed desirable. In this position, the appropriate tab 64 can be engaged by a suitable hand tool and bent laterally into the path of edge 58 of the sliding locking member 22.

I claim:

1. An enclosure comprising a container and a closure member, said container having a bottom, opposed sidewalls attached to the bottom and terminating in an open end, each of said opposed sidewalls having an inner wall surface opposed to an outer wall surface;

said closure member is removably affixed to and conforms to the open end; a downwardly extending lip on said closure member having an inner wall surface opposed to an outer wall surface; one of said inner and outer wall surfaces of said lip slidably adjoins one of said inner and outer wall surfaces of the container sidewalls when the closure member is mated respective to the container;

said container and closure member are in the form of a polygon and said lip telescopingly receives said open end;

a fixed locking member having an upper marginal end attached to the outer wall surface of one of said opposed sidewalls of the container and a lower marginal end spaced from the outer wall surface of said opposed sidewalls of the container, said fixed locking member has an inclined rail formed on said lower marginal end thereof;

a sliding locking member removably received on said enclosure, said sliding locking member having an upper flange that slidably bears against the top of the closure member and a lower rail engaging member of a size to slidably receive the rail therewithin and thereby force the closure member toward the bottom of the container when the sliding locking member simultaneously engages the closure member and fixed locking member.

2. The enclosure of claim 1 and further including a plurality of fixed and sliding locking members, wherein each one of said plurality of fixed and sliding locking members is positioned on each of said opposed sidewalls.

3. The enclosure of claim 1 wherein said fixed locking member is in the form of a bent plate member having an upper marginal end attached to the outer wall surface of one of said opposed sidewalls of the container in spaced relationship respective to the opening thereof and a lower marginal end displaced from said outer wall surface of one of said opposed sidewalls of the container and terminating in said rail at the lower end thereof; said rail downwardly slopes respective to the open end of the container to provide a wedge-like action when engaged by the sliding locking member; and cutouts in said lower marginal end of said fixed locking member that form tabs that can be bent outward away from the container to obstruct slidably movement of said sliding locking member.

4. The enclosure of claim 1 wherein said sliding locking member is in the form of a bent plate member having a flange at the upper end thereof, the lower marginal end being bent to provide a U-shaped rail receiving cavity which slops complementary respective to the rail and thereby receives the rail therewithin; and, cutouts in said lower marginal end of said fixed locking member that form tabs that can be bent outward away from the container to obstruct slidable movement of said sliding locking member.

5. In an enclosure comprising a container having opposed sidewalls attached to a bottom and terminating in an open end, the sidewalls having an inner wall surface opposed to an outer wall surface; a closure member removably affixed to and conforming to the configuration of said open end; said closure member having an upper surface; the improvement comprising:

a fixed locking member attached to the outer surface of one of the opposed sidewalls and spaced from said open end of said container, said fixed locking member having a rail thereon that is inclined respective to the open end of the container;

said container and closure member are a polygon and said closure member has a lip telescopingly received by said open end; there being one said fixed locking member on one side of the polygon, and seal means between the open end and the closure member;

a sliding locking member removably attached to said fixed locking member and said closure member, said sliding locking member having an upper flange that is slidably received against the upper surface of the closure member, said sliding locking member has a lower rail engaging member of a size to receive the rail therewithin and thereby force the closure member toward the bottom of the container when the sliding locking member simultaneously engages the closure member and fixed locking member.

6. The enclosure of claim 5 and further including a plurality of fixed and sliding locking members, wherein each one of said plurality of fixed and sliding locking members is positioned on each of said opposed sidewalls.

7. The enclosure of claim 5 wherein said fixed locking member is in the form of a bent plate member having an upper part attached to one sidewall of the container and a lower part displaced from the container sidewall and terminating in said rail at the lower end thereof; said rail downwardly slopes respective to the open end of the container to provide a wedge-like action when engaged by the sliding locking member.

8. The enclosure of claim 5 wherein said sliding locking member is in the form of a bent plate member having said flange at the upper end thereof, the lower marginal end being bent to provide a U-shaped rail receiving cavity which downwardly slopes complementary respective to the rail on the fixed locking member and thereby receives the rail therewithin; and, cutouts in said lower marginal end of said fixed locking member that form tabs that can be bent outward away from the container to obstruct slidable movement of said sliding locking member.

9. In an enclosure having a container in the form of a polygon that includes a bottom, sidewalls attached to the bottom, the container terminates in an open end, the sidewalls each having an inner wall surface opposed to an outer wall surface; a closure member removably affixed to and conforming to the configuration of the open end; the combination with said container and closure member of a locking apparatus;

said locking apparatus includes a fixed locking member attached to one of the container outer wall surfaces; said fixed locking member has an inclined rail formed thereon;

a sliding locking member having an upper flange that bears against the top of the closure member, and a lower rail engaging member of a size to receive the rail therewithin and thereby force the closure member toward the bottom of the container when the sliding locking member simultaneously engages the closure member and fixed locking member;

said sliding locking member is in the form of a bent plate member having said flange at the upper end thereof, the lower marginal end being bent to provide a U-shaped rail receiving cavity which downwardly slopes complementary respective to the rail and thereby receives the rail therewithin;

said container and closure member are in the form of a polygon and said closure member has a lip that telescopingly receives said open end, there being one said fixed locking member on one sidewall of the polygon, and seal means between the open end and the closure member.

10. The enclosure of claim 9 and further including a plurality of fixed and sliding locking members, wherein each one of said plurality of fixed and sliding locking members is positioned on each of said opposed sidewalls.

11. The enclosure of claim 9 is a polygon and said closure member having an inner wall surface of said lip engaging said outer wall surface of the container sidewalls; and, cutouts in said lower marginal end of said fixed locking member that form tabs that can be bent outward away from the container to obstruct slidably movement of said sliding locking member.

* * * * *